US007805857B2

(12) United States Patent
Ives

(10) Patent No.: US 7,805,857 B2
(45) Date of Patent: Oct. 5, 2010

(54) DUAL-PURPOSE DRYING AND COOLING APPARATUS

(75) Inventor: Alan T. Ives, Marcellus, MI (US)

(73) Assignee: Kadant Johnson, Inc., Three Rivers, MI (US)

( * ) Notice: Subject to any disclaimer, the term of this patent is extended or adjusted under 35 U.S.C. 154(b) by 670 days.

(21) Appl. No.: 11/646,769

(22) Filed: Dec. 28, 2006

(65) Prior Publication Data

US 2008/0155854 A1 Jul. 3, 2008

(51) Int. Cl.
*F26B 7/00* (2006.01)

(52) U.S. Cl. ..... 34/419; 34/124; 34/425; 34/426

(58) Field of Classification Search ..... 34/419, 34/420, 421, 423, 425, 426, 184, 124, 125; 285/95, 272, 276, 61; 165/90, 85, 88, 89; 162/359.1, 358.5

See application file for complete search history.

(56) References Cited

U.S. PATENT DOCUMENTS 1,564,171 A * 12/1925 Brown ..... 165/89
2,879,039 A * 3/1959 Skinner ..... 165/89
4,089,121 A * 5/1978 Sawyer ..... 34/452
5,943,788 A * 8/1999 Autio ..... 34/119
6,185,836 B1 * 2/2001 Zaoralek ..... 34/119

* cited by examiner

*Primary Examiner*—Kenneth B Rinehart
*Assistant Examiner*—Corey Hall
(74) *Attorney, Agent, or Firm*—Young Basile, P.C.

(57) ABSTRACT

A dual-purpose, cooling/drying apparatus comprising a rotatable cooling/drying cylinder wherein air, steam, and water supplied from sources external of the cooling/drying cylinder are selectively introducible into and removable from a space defined inside the cylinder. The apparatus includes a first flow path through which the water is selectively introducible into the cylinder space, and a second, separate flow path through which either of the air and steam are selectively introducible into the cylinder space. The apparatus is characterized by a cooling mode, in which the water and air are selectively introducible into the cylinder space through the first and second flow paths, respectively, and a drying mode, wherein the steam is selectively introducible into the cylinder space through the second flow path.

3 Claims, 4 Drawing Sheets

DUAL-PURPOSE DRYING AND COOLING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The invention pertains generally to dual-purpose cooling and drying apparatus such as are employed, for instance, in the paper-making industry, wherein air, steam, and water supplied from sources external of a rotatable cylinder are selectively introducible into and removable from a space defined inside the cylinder. More particularly, the present invention relates to such dual-purpose apparatus having a first flow path through which the water is selectively introducible into the cylinder space, and a second, separate flow path through which either of the air and steam are selectively introducible into the cylinder space.

BACKGROUND

In the paper manufacturing industry, for instance, it is commonplace to employ a series of rotating steam-heated cylinders to raise the temperature of a paper web as it passes over these cylinders, thereby increasing the drying rate of the paper web. More particularly, steam from an external source is introduced to a space defined inside each cylinder.

Subsequent to this drying step, the paper web is typically wound onto a shaft. If the temperature of the paper web is too high when it is wound, the web may curl and physical properties such as brightness, tensile strength, and caliper may also be adversely affected. To reduce or eliminate these adverse effects, it is commonplace to cool the paper web. Conventionally, cooling can be accomplished with dual-purpose cylinders—also known as "swing dryers"—that function, alternately, to both cool and dry the paper web. While the drying function, as explained above, is performed by introducing steam into the space inside the cylinder, cooling is accomplished through the introduction of water into the cylinder to cool the paper web before it is wound on the shaft.

Whereas steam naturally occupies the entire space inside the cylinder, thus ensuring the even heating of the cylinder in a drying mode, cooling water must be purposefully distributed evenly to avoid wide temperature deviations across the surface of the cylinder. Otherwise, the cylinder performs its cooling function less effectively. Conventionally, cooling water may be introduced inside the cylinder via a rotating distribution member attached to the inside of the cylinder, the member having a series of evenly-spaced holes through which the water is sprayed. Alternative means include a stationary distribution member which includes one or more fixed-position water spray-nozzles.

One such conventional swing-dryer is shown in FIG. 1 to comprise a rotatable cylinder 1 having journalled ends 2*a*, 2*b* with a rotary joint 5*a* or 5*b*, respectively, connected to each. Each journal 2*a*, 2*b* is hollow, as shown, defining an internal axial passageway communicating with the space 3 inside the cylinder.

The first rotary joint 5*a* forms part of a flow path through which steam S from an external source (not shown) is selectively supplied to the interior space 3. This steam flow path is also defined in part by the passageway through the journal 2*a*. A first rotating siphon 10 extending through the journal 2*a* from the interior space 3 to the rotary joint 5*a* defines a flow path for evacuating steam condensate from the interior space 3 and discharging it to an outlet $O_S$ connected to the rotary joint 5*a*.

The second rotary joint 5*b* forms part of a flow path through which air A and cooling water W are selectively supplied to the interior space 3, the water being distributed within that space through nozzles defined in a support spider 12. A second rotating siphon 11 extending through the journal 2*b* from the interior space 3 to the rotary joint 5*b* defines a flow path for evacuating cooling water from the interior space 3 and discharging it to an outlet $O_W$ connected to the rotary joint 5*b*.

While prior art swing dryers satisfactorily perform their heating and cooling functions, they are attended by certain drawbacks. For instance, the presence of multiple, mechanically complex rotary joints, such as shown in the exemplary swing-dryer of FIG. 1, necessarily increases maintenance costs and complexity. Also, water distribution within existing swing dryers can be uneven, leading to unwanted variations in temperature across the cylinder. Further, evacuation of steam condensate and, alternately, cooling water requires high pressure differentials within rotating siphons. Still further, the flow of steam, air, and water, as well as the distribution cooling water cannot be independently controlled. It would thus be desirable to provide a dual-purpose cooling/drying cylinder which is simpler and less expensive to maintain, and which more efficiently serves the heating and cooling functions.

SUMMARY OF THE DISCLOSURE

The present invention addresses the shortcomings of the prior art, and encompasses other features and advantages, through the provision of a dual-purpose, cooling/drying apparatus comprising a rotatable cooling/drying cylinder wherein air, steam, and water supplied from sources external of the cooling/drying cylinder are selectively introducible into and removable from a space defined inside the cylinder. The apparatus has a first flow path through which the water is selectively introducible into the cylinder space, and a second, separate flow path through which either of the air and steam are selectively introducible into the cylinder space. The apparatus is characterized by a cooling mode, in which the water and air are selectively introducible into the cylinder space through the first and second flow paths, respectively, and a drying mode, wherein the steam is selectively introducible into the cylinder space through the second flow path.

While the first and second flow paths may be defined through separate rotary joints, one on each end of the cylinder, the separate first and second flow paths are, in one embodiment of this invention, defined through a single rotary joint associated with the cooling/drying cylinder. This configuration beneficially reduces the mechanical complexity of the apparatus.

According to another feature of the present invention, steam, steam condensate, air and water are selectively removable from the cooling/drying cylinder space via a common third flow path separate from the first and second flow paths.

This common flow path may, as in one embodiment of this invention, comprise a siphon communicating the cooling/drying cylinder space through the rotary joint to an outlet.

Per yet another feature of the present invention, the first flow path for selectively introducing water into the cooling/drying cylinder space further comprises at least one distribution nozzle characterized by a variable orientation so that the direction in which water is introduced into the cooling/drying cylinder space may be selectively varied.

WRITTEN DESCRIPTION

Figure 1:
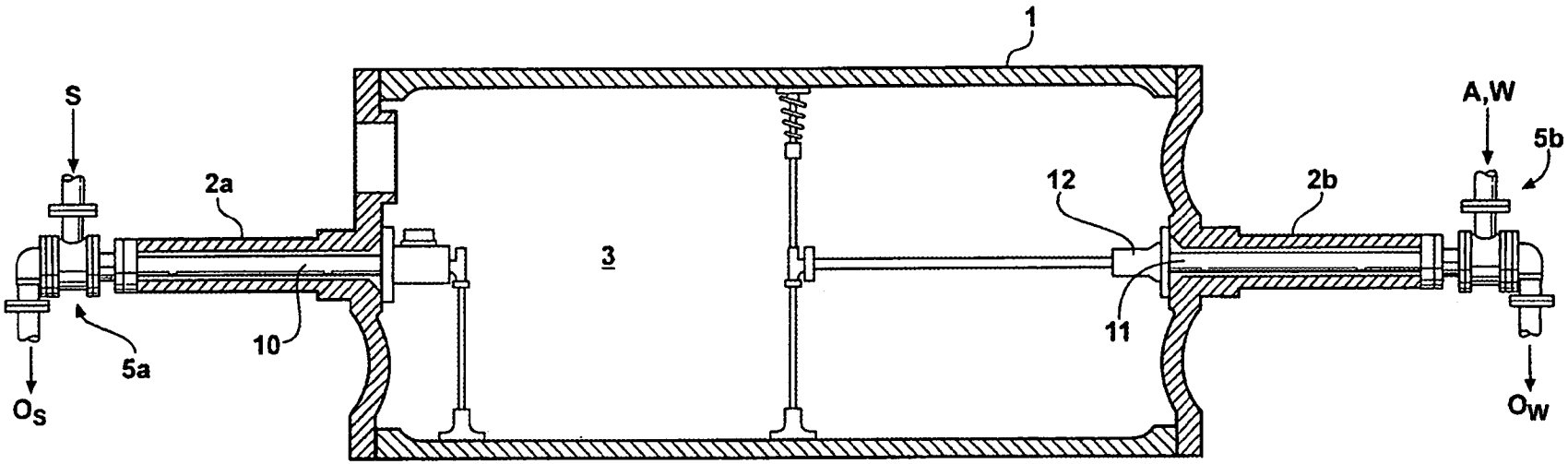
FIG - 1 (PRIOR ART)
FIG. 1 is a longitudinal cross-section of an exemplary prior art dual-purpose drying/cooling apparatus.
Figure 2:
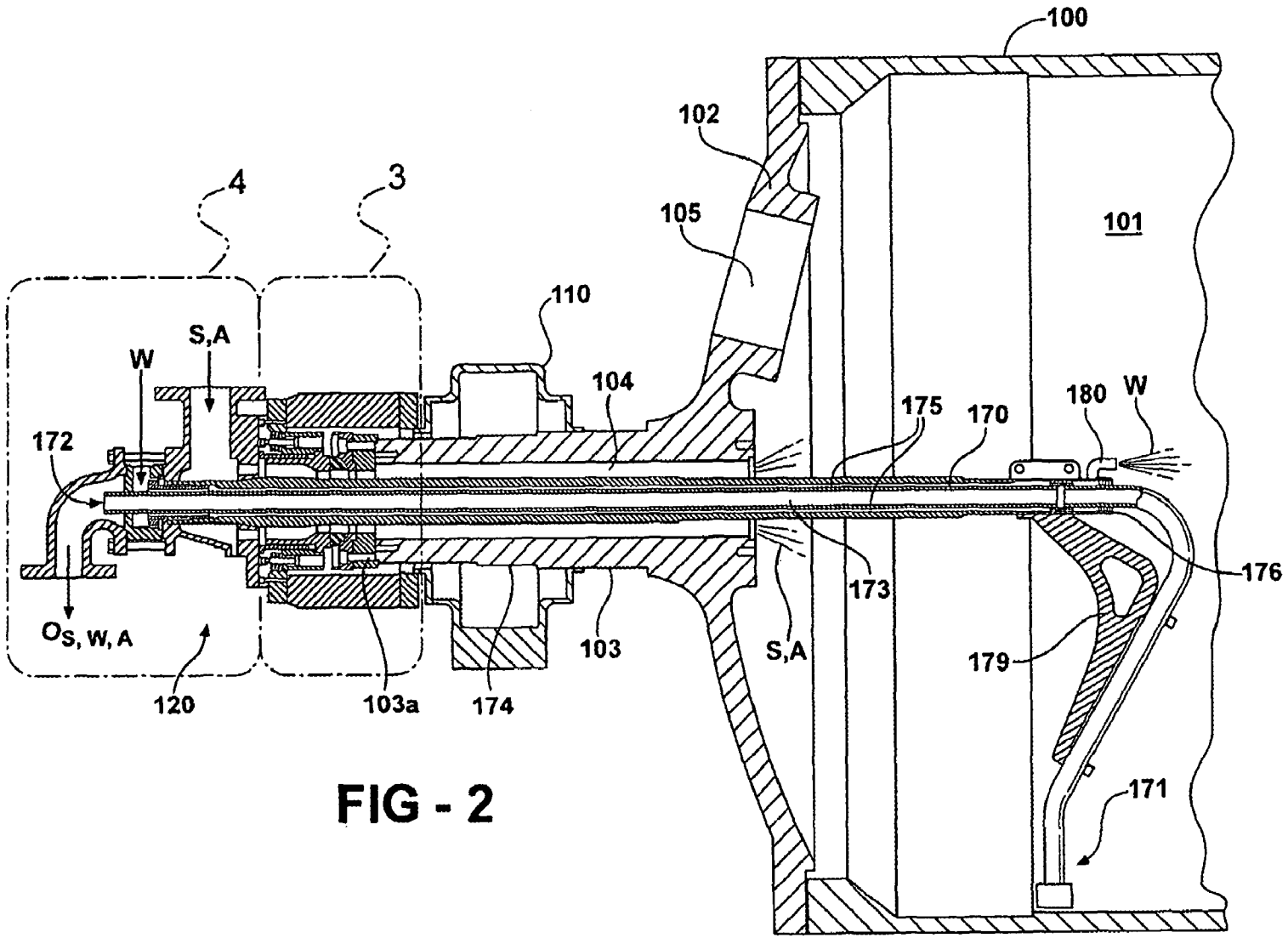
FIG. 2 is a detailed longitudinal cross-section of a dual-purpose drying/cooling apparatus according to the present invention.
Figure 3:
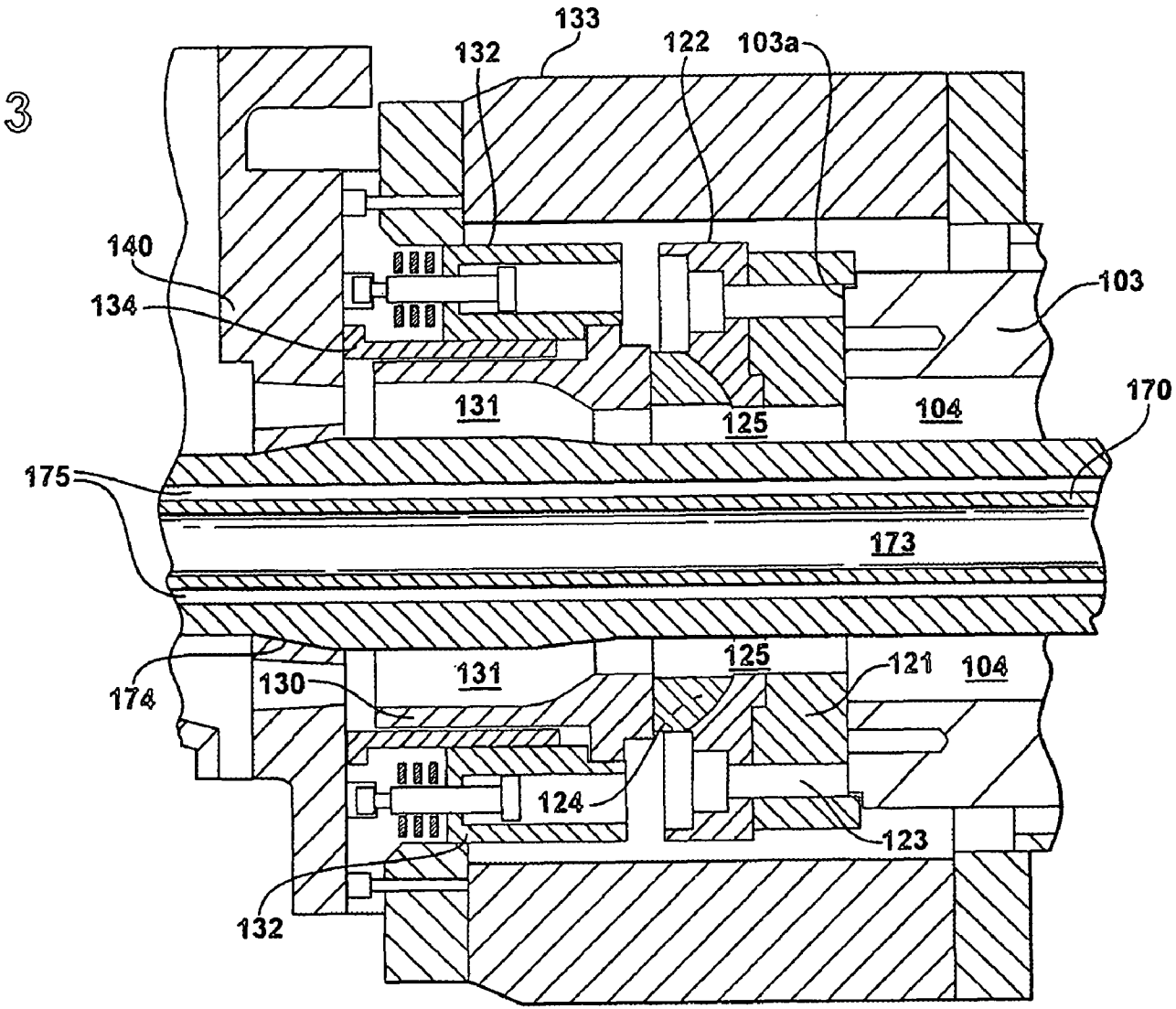
FIG. 3 is a more detailed view of a portion of the present-inventive dual-purpose drying/cooling apparatus taken from FIG. 2.
Figure 4:
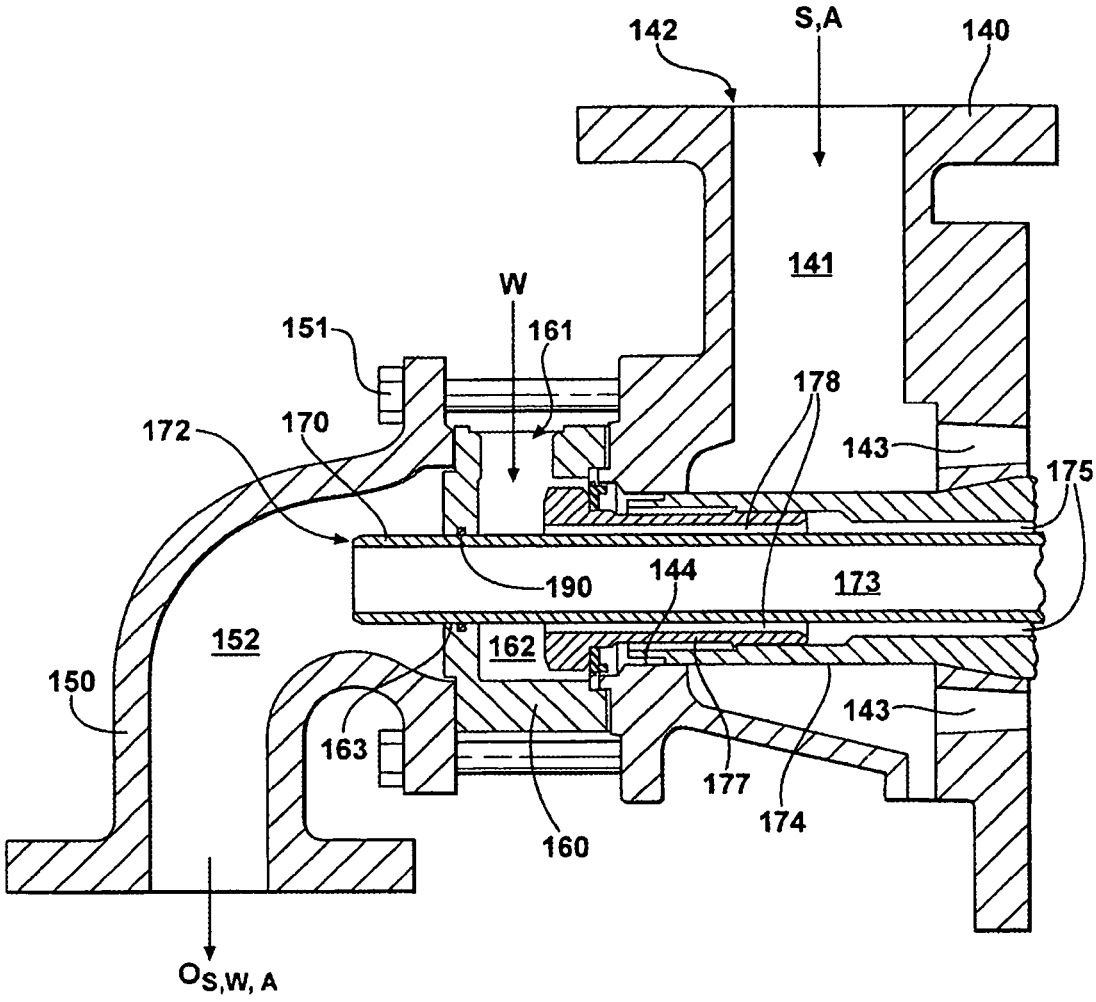
FIG. 4 is a more detailed view of another portion of the present-inventive dual-purpose drying/cooling apparatus taken from FIG. 2.

Referring now to the FIGS. 2 through 4, wherein like numerals refer to like or corresponding parts, the present invention will be seen to generally comprise a dual-purpose cooling/drying apparatus of the type including a rotatable cylinder 100 wherein air, steam, and water supplied from sources external (not shown) of the cylinder are selectively introducible into and removable from a space 101 defined within the cylinder.

Referring specifically to FIG. 2, the cylinder 100 is, per convention, a rotatable drum fashioned from metal. Opposite end walls 102 (only one end-wall is depicted in FIG. 2) are coaxially journalled for rotatably supporting the cylinder in bearing housings 110, all in known fashion. As shown, at least one journal 103 is hollow along its axial length, thus defining an internal passageway 104 communicating the cylinder interior space 101 with the external air, steam, and water supplies (not shown) via a rotary joint (indicated generally at 120) associated with the end of the journal, all as described further hereinbelow. According to convention, a manhole opening 105 may be provided through the end wall 102 to permit inspection of the interior space 101.

The rotary joint 120 is of conventional construction in that it comprises a stationary portion sealingly engaging a rotatable portion which is, in turn, secured to the end face 103*a* of the cylinder journal 103.

Turning now to FIG. 3, the rotatable portion of rotary joint 120 will be seen to include a first member 121 and a seal seat-member 122 connected to the cylinder journal end face 103*a*, for instance by bolts 123 or the like. The seal seat-member 122 includes a cavity in the outside face thereof for supporting an annular seal 124.

Each of the first member 121, the seal seat-member 122 and the seal 124 include central openings therethrough which, as depicted, collectively define a passageway 125 communicating with the passageway 104 defined through the hollow journal 103.

Still referring to FIG. 3, the stationary portion of rotary joint 120 includes a first non-rotating, axially "floating" sealing member 130 having, as depicted, an annular end face sealingly engaging the opposing annular end face of the seal 124 to thus sandwich the seal between the sealing member 130 and the rotatable seal seat-member 122. The sealing member 130 includes a central opening 131 defining a passageway therethrough communicating with the passageway 125 defined through the several elements of the rotatable portion of the rotary joint 120. As indicated, the non-rotating sealing member 130 is axially moveable, being captured by a spring-biased, floating body 132 which is in turn secured to part of a non-rotating, stationary housing 133 enclosing the aforedescribed portions of the rotary joint 120. A fixed sleeve 134 connected to the adjacent inlet conduit 140 (described further below) is disposed between the sealing member 130 and the floating body 132, and seals the sealing member opening 131 relative thereto.

Of course, it will be appreciated by those skilled in the art that the foregoing rotary joint configuration is exemplary only, and that the objects of the present invention, all as explained herein, may be served by numerous rotary joint configurations, all of which are known in, or within the ordinary level of skill of those in, the art.

Referring now to FIG. 4, there is secured to the end of the stationary housing (not shown) an inlet coupling 140 having an internal passageway 141 communicating with an inlet opening 142 through which steam and air alternately enter the coupling 140 from external sources (not shown), an annular outlet opening 143 communicating with the passageway 131 defined through the stationary sealing member 130 (shown in FIG. 3), and a further outlet opening 144 for receiving therethrough the end portion of the siphon tube 170 of a siphon assembly described further below.

Mounted upon the end of the inlet coupling 140, such as for instance by bolts 151 as shown, there is an outlet coupling 150 defining therethrough a passageway 152 for communicating the outlet end 172 of the siphon tube 170 to one or more external destinations (not shown) for receiving steam, steam condensate, cooling water, and air $O_{S,W,A}$ evacuated from the cylinder interior space 101.

Between the outlet coupling 150 and the end face of the inlet coupling 140 there is captured, as shown, a further inlet member 160 having an inlet opening 161 communicating with an interior passageway 162. The passageway 162 communicates with a passageway defined by the siphon assembly as hereafter described, such that cooling water W from an external source (not shown) may be selectively introduced into the cylinder interior space 101 via the inlet member 160. A further opening 163 provided through the inlet member 160 is dimensioned to receive therethrough the siphon tube 170 of the siphon assembly.

Referring again to FIGS. 2 through 4, according to the present invention steam, steam condensate, air and water are all selectively removable from the cooling/drying cylinder space 101 via a common flow path separate from the flow paths employed for the introduction of water W, air A and steam S. As shown, this common flow path takes the form of a stationary siphon assembly including a siphon tube 170 extending from a first inlet end 171 positioned in the cylinder space 101, through the passageway 104 defined in the hollow journal 103, through the rotary joint 120, and terminating at an outlet end 172 positioned adjacent to and in communication with the passageway 152 defined through outlet coupling 150.

The siphon assembly includes, as shown, a hollow siphon tube 170 defining an internal passageway 173 terminating at one end in the inlet end 171 positioned proximate the interior surface of the cylinder 100 wall to permit evacuation of the steam, steam condensate, air and water gathering there during operation. At the opposite end the siphon tube 170 passageway 173 terminates in the outlet end 172 through which steam, steam condensate, air and water is evacuated to the outlet coupling 150. The end portion of the siphon tube 170 proximate this outlet end 172 is received through the opening 163 through the inlet member 160, being sealed relative thereto by an O-ring 190, for example.

The siphon tube 170 is disposed within a hollow siphon support-tube 174 having a larger internal diameter than the siphon tube 170 outside diameter. The siphon tube 170 is supported with the hollow support tube 174 so as to define a generally concentric passageway 175 between the outside surface of the siphon tube 170 and the inside surface of the support tube 174. Particularly in the embodiment of the invention as shown, the end of the support tube 174 disposed within the interior space 101 of the cylinder has provided therein a sealing element 176 which seals the support tube 174 relative to the siphon tube 170, and further aligns the siphon tube generally coaxial with the support tube. At the opposite end thereof, the support tube 174 is received within the correspondingly dimensioned opening 144 defined through the inlet coupling 140. As best shown in FIG. 4, a bushing 177 having a longitudinal passageway 178 therethrough is disposed partially within this opposite end of the support tube 174 and in sealed relationship thereto. The siphon tube 170 extends through the passageway 178 as shown, the inside diameter of this passageway 178 being greater than the outside diameter of the siphon tube 170 so that the passageway communicates the support tube passageway 175 with the inlet conduit opening 161.

As shown in FIG. 2, the end of the siphon tube 170 extending into the interior space 101 is curved, projecting beyond the support tube 174 and being supported relative thereto by a bracket 179 secured at one end to the support tube and at the other end to the siphon tube.

At least one nozzle 180 disposed on the support tube 174 communicates with the concentric passageway 175 to communicate water W therethrough and into the interior space 101 of the cylinder 100. This at least one nozzle 180 may be movably mounted on the support tube 174 so as to be rotatable relative thereto to thus vary the rotational orientation of the nozzle. The at least one nozzle 180 may further be articulated along its length to vary the angle thereof relative to the longitudinal axis of the support tube 174.

With continuing reference to FIGS. 2 through 4, the cooling/drying apparatus of the present invention comprises a first flow path for selectively introducing water W into the drying cylinder interior space 101, and a second, separate flow path for selectively introducing either air A or steam S into the drying cylinder space 101 depending upon which mode of operation—cooling or drying—the apparatus is in. In the illustrated embodiment, the first flow path is defined by the combined communicating passageways of the inlet member 160, bushing 177 and siphon support tube 174, and terminating in at least one nozzle 180. The second air and steam flow path, also according to this embodiment, is defined by the combined communicating passageways of the inlet coupling 140, the sealing member 130, seal 124, seal seat member 122 and first member 121 of the rotary joint 14, and the cylinder journal 103, and terminating at the interface between the end of the journal passageway and the interior space 101. This second flow path is, as indicated, alternatively used to convey air into the cylinder interior space when, for instance, the dual-purpose apparatus is used to cool a paper web. Such alternative introduction of steam and air is, in one embodiment, achieved by placing one or more valves in the steam and air inlet lines (not shown) to allow the steam and air flows to be selectively stopped and started. As those skilled in the art will appreciate, conventional means such as, for example, check valves and/or "block and bleed" shut-off valves can be used for this purpose.

It will be appreciated from the foregoing disclosure that the present invention, by introducing the air through a separate flow path from the cooling water, allows the cooling water to spray without being influenced by the amount of air that is metered into the cylinder, thereby allowing the cooling water to be distributed more accurately into, and farther across, the interior space in the cylinder. This necessarily reduces temperature variations caused by the uneven distribution of cooling water which is found in some prior art swing dryers.

Furthermore, the separate steam and air flow path provides a much larger flow capacity than the cooling water flow path.

As will also be appreciated, the steam enters the cylinder through a flow path that is separate from the cooling water flow path. Advantageously in comparison with the prior art, this allows a much larger steam flow capacity without affecting the cooling water nozzle sizes and subsequently the cooling water distribution inside the cylinder.

As will also be understood and appreciated, the adjustability of the one or more spray nozzles facilitates a more uniform cooling capacity and even temperature distribution across the width of the cylinder as compared with prior art swing dryers.

Of course, the foregoing is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. In a dual-purpose rotatable cooling and drying apparatus of the type comprising a rotatable cylinder wherein air, steam, and water supplied from sources external of the cooling and drying cylinder are selectively introducible into and removable from a space defined inside the cylinder, the cylinder having associated therewith at least one rotary joint and at least one hollow journal, the improvement comprising:

a first tubular member that extends through the hollow journal;

a second tubular member that extends through the first tubular member;

a first flow path through which the water is selectively introducible into the cylinder space, the first flow path defined between an outer periphery of the second tubular member and an inner periphery of the first tubular member;

a second, separate flow path through which either of the air or the steam are selectively introducible into the cylinder space, the second flow path defined between an outer periphery of the first tubular member and an inner periphery of the hollow journal;

a third flow path through which steam condensate and water is selectively removable from the cooling and drying cylinder space, the third flow path defined within the second tubular member;

wherein the apparatus is characterized by a cooling mode, in which the water and air are selectively introducible into the cylinder space through the first and second flow paths, respectively, and a drying mode, wherein the steam is selectively introducible into the cylinder space through the second flow path; and wherein the first flow path, the second flow path, and the third flow path are defined through the same rotary joint associated with the rotatable cooling and drying cylinder.

2. The dual-purpose cooling and drying apparatus of claim 1, wherein the third flow path comprises a siphon communicating with the cooling and drying cylinder space through the rotary joint to an outlet.

3. The dual-purpose cooling and drying apparatus of claim 1, wherein the first flow path for selectively introducing water into the cooling and drying cylinder space further comprises at least one distribution nozzle characterized by a variable orientation so that the direction in which water is introduced into the cooling and drying cylinder space may be selectively varied.

* * * * *